US010700430B1

(12) United States Patent
Abbasi

(10) Patent No.: US 10,700,430 B1
(45) Date of Patent: Jun. 30, 2020

(54) PARASITIC MULTIFILAR MULTIBAND ANTENNA

(71) Applicant: Maxtena, Inc., Rockville, MD (US)

(72) Inventor: Fereshteh Abbasi, St. George's (GD)

(73) Assignee: Maxtena, Inc., Rockville, MD (US)

( * ) Notice: Subject to any disclaimer, the term of this patent is extended or adjusted under 35 U.S.C. 154(b) by 225 days.

(21) Appl. No.: 15/831,335

(22) Filed: Dec. 4, 2017

Related U.S. Application Data

(60) Provisional application No. 62/429,854, filed on Dec. 4, 2016.

(51) Int. Cl.
*H01Q 5/30* (2015.01)
*H01Q 1/36* (2006.01)
(Continued)

(52) U.S. Cl.
CPC ..... *H01Q 5/392* (2015.01); *H01Q 1/362* (2013.01); *H01Q 1/38* (2013.01); *H01Q 3/40* (2013.01)

(58) Field of Classification Search
CPC ..... H01Q 1/24; H01Q 1/241; H01Q 1/242; H01Q 1/243; H01Q 1/36; H01Q 1/362; H01Q 1/38; H01Q 11/00; H01Q 11/02; H01Q 11/04; H01Q 11/08; H01Q 11/083; H01Q 5/30; H01Q 5/307; H01Q 5/314; H01Q 5/328; H01Q 5/335; H01Q 5/357; H01Q 5/364; H01Q 5/378; H01Q 5/385;
(Continued)

(56) References Cited

U.S. PATENT DOCUMENTS 4,008,479 A 2/1977 Smith
5,678,201 A 10/1997 Thill
(Continued)

FOREIGN PATENT DOCUMENTS

GB 2468583 A 9/2010
WO 2011001006 A1 1/2011

OTHER PUBLICATIONS

Harxon GNSS Antenna Series specifications sheet, OEM Helix Antenna HX-CH6017A, pp. 1-2, accessible Jul. 2016.

*Primary Examiner* — Daniel Munoz
*Assistant Examiner* — Patrick R Holecek
(74) *Attorney, Agent, or Firm* — Patents and Licensing LLC; Daniel W. Juffernbruch

(57) ABSTRACT

A multi-band antenna has a plurality of primary filar antenna elements and a plurality of parasitic filar antenna elements. Primary feed ends are coupled to feed signals. Parasitic feed ends are coupled to a common ground. Respective primary filar antenna elements and parasitic filar antenna elements are adjacently spaced from one another by a parasitic distance sufficiently narrow to shorten the primary and parasitic physical lengths relative to the primary and parasitic electrical lengths. The primary and parasitic filar antenna elements are capacitively coupled across the parasitic distance and can have different physical lengths. An optional additional filar antenna element has a bottom end coupled to the common ground. The additional filar antenna element can be distanced from the primary filar antenna element a separation distance sufficient to avoid capacitive coupling therebetween and can be greater than the parasitic distance. A process can obtain the parasitic distance for the antenna.

18 Claims, 12 Drawing Sheets

(51) Int. Cl.

| | |
|---|---|
| ***H01Q 11/08*** | (2006.01) |
| ***H01Q 5/392*** | (2015.01) |
| ***H01Q 1/38*** | (2006.01) |
| ***H01Q 3/40*** | (2006.01) |

(58) Field of Classification Search
CPC ..... H01Q 5/392; H01Q 9/27; H01Q 9/28; H01Q 9/44; H01Q 21/24; H01Q 21/245; H01Q 21/29
See application file for complete search history.

(56) References Cited

U.S. PATENT DOCUMENTS

| | | | | |
|---|---|---|---|---|
| 5,828,348 | A | 10/1998 | Tassoudji | |
| 5,909,196 | A | 6/1999 | O'Neill | |
| 5,943,027 | A | 8/1999 | Thill | |
| 5,990,847 | A * | 11/1999 | Filipovic | H01Q 11/08 343/895 |
| 6,094,178 | A | 7/2000 | Sanford | |
| 6,184,844 | B1 | 2/2001 | Filipovic | |
| 6,421,028 | B1 | 7/2002 | Ohgren | |
| 8,681,070 | B2 | 3/2014 | DiNallo | |
| 9,214,734 | B2 * | 12/2015 | Huynh | H01Q 11/08 |
| 9,614,293 | B2 * | 4/2017 | Elliot | H01Q 21/30 |
| 2005/0162334 | A1 | 7/2005 | Saunders | |
| 2005/0243014 | A1 | 11/2005 | Bryan | |
| 2005/0275601 | A1 | 12/2005 | Jostell | |
| 2008/0174501 | A1 | 7/2008 | Licul | |
| 2011/0254755 | A1 | 10/2011 | DiNallo | |

* cited by examiner

PARASITIC MULTIFILAR MULTIBAND ANTENNA

BACKGROUND OF THE INVENTIONS

1. Technical Field

The present inventions relate to multifilar antennas and, more particularly, relate to multifilar multiband antennas.

2. Description of the Related Art

Quadrifilar helix antennas are known for receiving circularly polarized radio frequency signals from satellites. When one or more satellites operate on different frequency bands, multiband antennas are useful.

When building multiband quadrifilar helix antennas little space is available to accommodate all bands and performance suffers.

What is needed is a compact multiband quadrifilar helix antenna with improved performance in a smaller package.

BRIEF DESCRIPTION OF THE DRAWINGS

The present inventions are illustrated by way of example and are not limited by the accompanying figures, in which like references indicate similar elements. Elements in the figures are illustrated for simplicity and clarity and have not necessarily been drawn to scale.

The details of the preferred embodiments will be more readily understood from the following detailed description when read in conjunction with the accompanying drawings wherein.

DETAILED DESCRIPTION OF THE PREFERRED EMBODIMENTS

Figure 1:
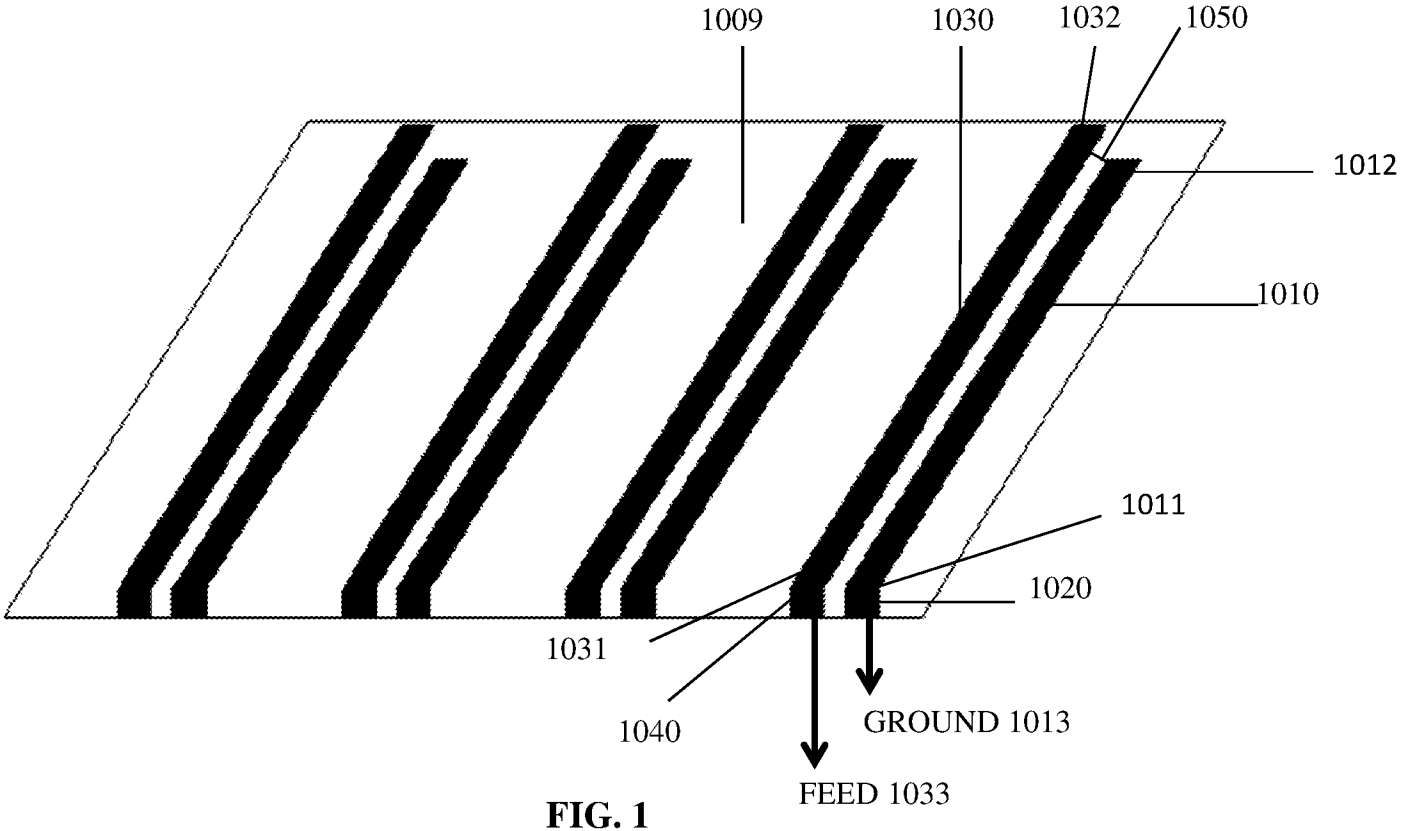
FIG. 1 illustrates an unwrapped plan view of a flat antenna printed circuit for a cylindrical quadrifilar helix antenna according to a first embodiment of the present inventions.

FIG. 1 illustrates an unwrapped plan view of a flat antenna printed circuit for a cylindrical quadrifilar helix antenna according to a first embodiment of the present inventions. A parasitic filar antenna element 1010 is shown which consists of a feed end 1011 and an opposing end 1012, where the feed end is connected to a common ground 1013 through a bottom section 1020. A primary filar antenna element 1030 is shown which consists of a feed end 1031 and an opposing end 1032, where the feed end is connected to a feed 1033 through bottom section 1040.

The filar antenna elements 1010 and 1030 are adjacently spaced by a narrow parasitic distance 1050 yielding strong capacitive coupling between the primary filar antenna element 1030 and the parasitic filar antenna element 1010. The primary filar antenna element 1030 has a primary resonance frequency corresponding to its electrical length, ideally a quarter of a wavelength at a primary desired frequency, or an odd multiple of a quarter of a wavelength corresponding to a higher order mode of the primary desired frequency.

Due to the capacitive coupling between the two filar antenna elements 1010 and 1030, the parasitic filar antenna element 1010 has a parasitic resonant frequency corresponding to its electrical length, ideally a quarter of a wavelength, or an odd multiple of a quarter of a wavelength corresponding to a higher order mode of a parasitic desired frequency. By sufficiently decreasing the distance 1050, the bandwidth of the resonance corresponding to the parasitic filar antenna element 1010 will increase and will be comparable to the bandwidth of the resonance of the primary filar antenna element 1030.

Furthermore, as a result of such coupling, both filar antenna elements 1010 and 1030 will have a longer electrical length relative to their physical length. In order to achieve the desired resonant frequency for each of these two filar antenna elements, the required physical length of each filar antenna element 1010, 1030 becomes shorter as the parasitic distance 1050 decreases. As a result using this approach leads to shorter overall antenna height.

Electrical length is also dependent on environment factors such as dielectric constant of any surrounding objects such as the substrate, a cylindrical sleeve, or a radome. The desired frequency of the antenna elements can be defined as a center frequency of a desired frequency band of interest.

The coupling between filar antenna elements 1010 and 1030 has a direct effect on their electrical length too, in a mutual way. Changing the physical length of each of the two filar antenna elements 1010 and 1030 will affect the electrical length and hence the resonance frequency of the other. Hence the two filar antenna elements 1010 and 1030 must be designed and matched simultaneously.

While in a preferred embodiment of the invention, the filar antenna elements 1010 and 1030 each have an electrical length equal to an odd multiple of a quarter of a wavelength at the desired frequency of each, such electrical length is not a requirement and shorter or longer electrical length for filar elements can still be used in alternative embodiments in conjunction with appropriate matching method.

The illustrated ground connection 1013 is a direct electrical connection. An alternative ground connection is through a matching network. The illustrated feed connection 1033 is through a direct electrical connection. An alternative feed connection is through a matching network. Also in an alternative feed arrangement, alternatively filar antenna element 1010 connects to the feed 1033 through the bottom section 1020 and filar antenna element 1030 could couple to the common ground 1013 through bottom end 1040.

In FIG. 1 four identical pairs of filar antenna elements 1010 and 1030 are uniformly separated on a dielectric substrate 1009 that will be wrapped around a cylindrical sleeve to assemble the quadrifilar helix antenna.

Figure 2:
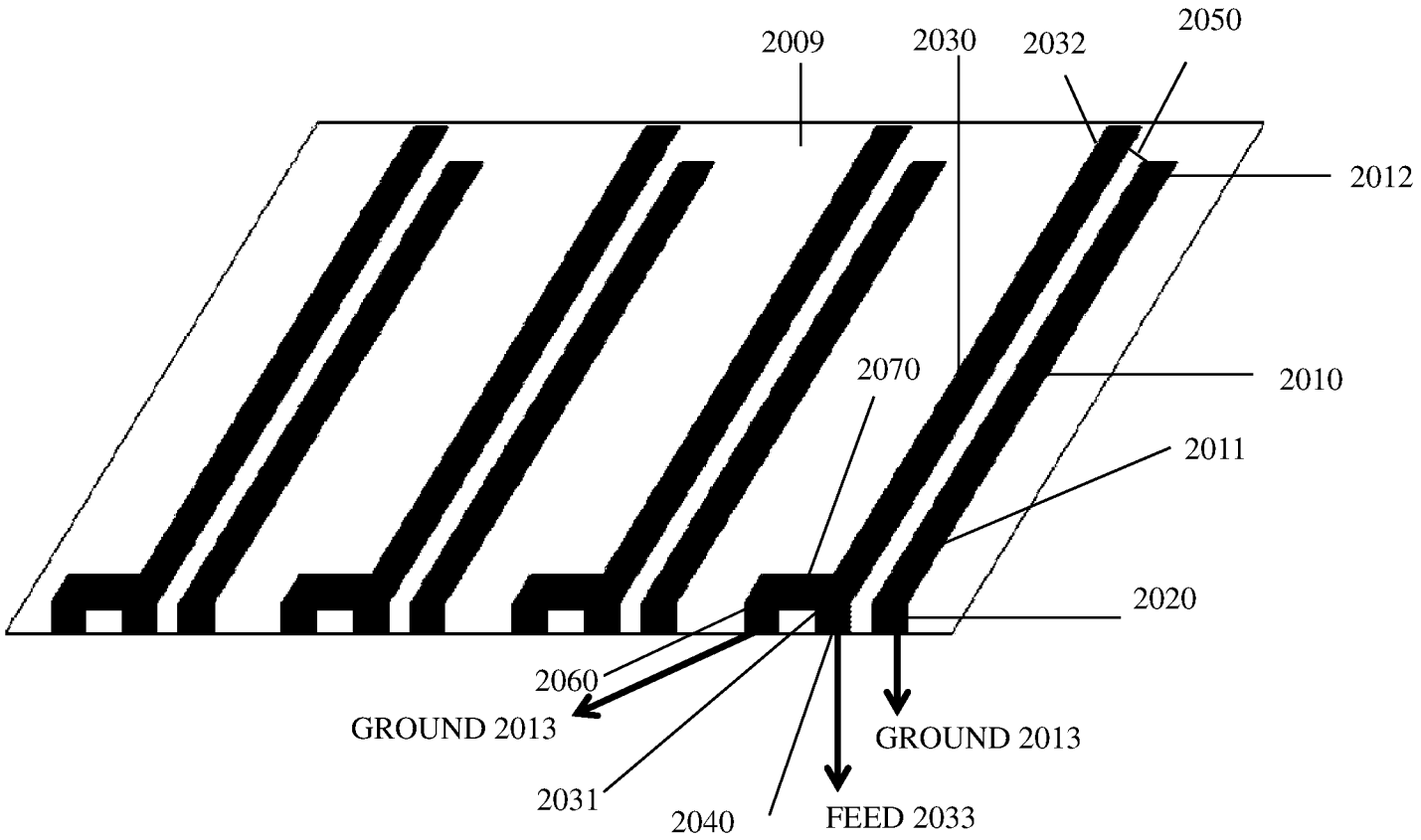
FIG. 2 illustrates an unwrapped plan view of a flat antenna printed circuit for a cylindrical quadrifilar helix antenna according to a second embodiment of the present inventions.

FIG. 2 illustrates an unwrapped plan view of a flat antenna printed circuit for a cylindrical quadrifilar helix antenna according to a second embodiment of the present inventions. A parasitic filar antenna element 2010 is shown which consists of a feed end 2011 and an opposing end 2012, where the feed end is connected to a common ground 2013 through a bottom section 2020. A primary filar antenna element 2030 is shown which consists of a feed end 2031 and an opposing end 2032, where the feed end is connected to a feed 2033 through bottom section 2040. A substantially horizontal tuning strip 2070 is extended from the feed end 2031 of the filar antenna element 2030, and connects to a bottom section 2060 which is connected to a common ground 2013.

The filar antenna elements 2010 and 2030 are adjacently spaced by a narrow parasitic distance 2050 yielding strong capacitive coupling between the primary filar antenna element 2030 and the parasitic filar antenna element 2010. The primary filar antenna element 2030 has a resonance frequency corresponding to its electrical length, ideally a quarter of a wavelength or an odd multiple of a quarter of a wavelength corresponding to a higher order mode at a primary desired frequency.

Due to the capacitive coupling between the two filar antenna elements 2010 and 2030, the parasitic filar antenna element 2010 also has a resonance frequency corresponding to its electrical length, ideally a quarter of a wavelength, or an odd multiple of a quarter of a wavelength corresponding to a higher order mode of a parasitic desired frequency.

By sufficiently decreasing the distance 2050, the bandwidth of the resonant frequency band corresponding to the parasitic filar antenna element 2010 will increase and will be comparable to the bandwidth of the resonance of the primary filar antenna element 2030.

Furthermore, as a result of such coupling distance, both filar antenna elements 2010 and 2030 will have a longer electrical length relative to their physical length. In order to achieve the desired resonant frequency for each of these two filar antenna elements, the required physical length of each filar antenna element 2010, 2030 becomes shorter as the parasitic distance 2050 decreases and the capacitive coupling between the two gets stronger. As a result using this approach leads to shorter overall antenna height.

Electrical length is also dependent on environment factors such as dielectric constant of any surrounding objects such as the substrate, a cylindrical sleeve, or a radome.

The coupling between filar antenna elements 2010 and 2030 has a direct effect on their electrical length too, in a mutual way. Changing the length of each of the two filar antenna elements 2010 and 2030 will affect the electrical length and hence the resonance frequency of the other. Hence the two filar antenna elements 2010 and 2030 must be designed and matched simultaneously.

While in a preferred embodiment of the invention, the filar antenna elements 2010 and 2030 each have an electrical length equal to an odd multiple of a quarter of a wavelength at the desired frequency of each, such electrical length is not a requirement and shorter or longer electrical length for filar elements can still be used in alternative embodiments in conjunction with appropriate matching method.

The tuning strip matches the impedance of filar antenna element 2030 to the feed line of feed 2033. The impedance of the feed line is 50 ohms. Further details of the tuning strip are incorporated herein by reference to U.S. patent application Ser. No. 13/019,497 filed on Feb. 2, 2011 and 61/300,496 filed on Feb. 2, 2010 by Carlo DiNallo of the same Assignee Applicant and published on Oct. 20, 2011 as US Patent Publication number 20110254755.

The two illustrated ground connections 2013 are a direct electrical connection. An alternative ground connection is through a matching network. The illustrated feed connection 2033 is through a direct electrical connection. An alternative feed connection is through a matching network.

In FIG. 2 four identical pairs of filar antenna elements 2010 and 2030 are uniformly separated on a dielectric substrate 2009 that will be wrapped around a cylindrical sleeve to assemble the quadrifilar helix antenna.

Figure 3:
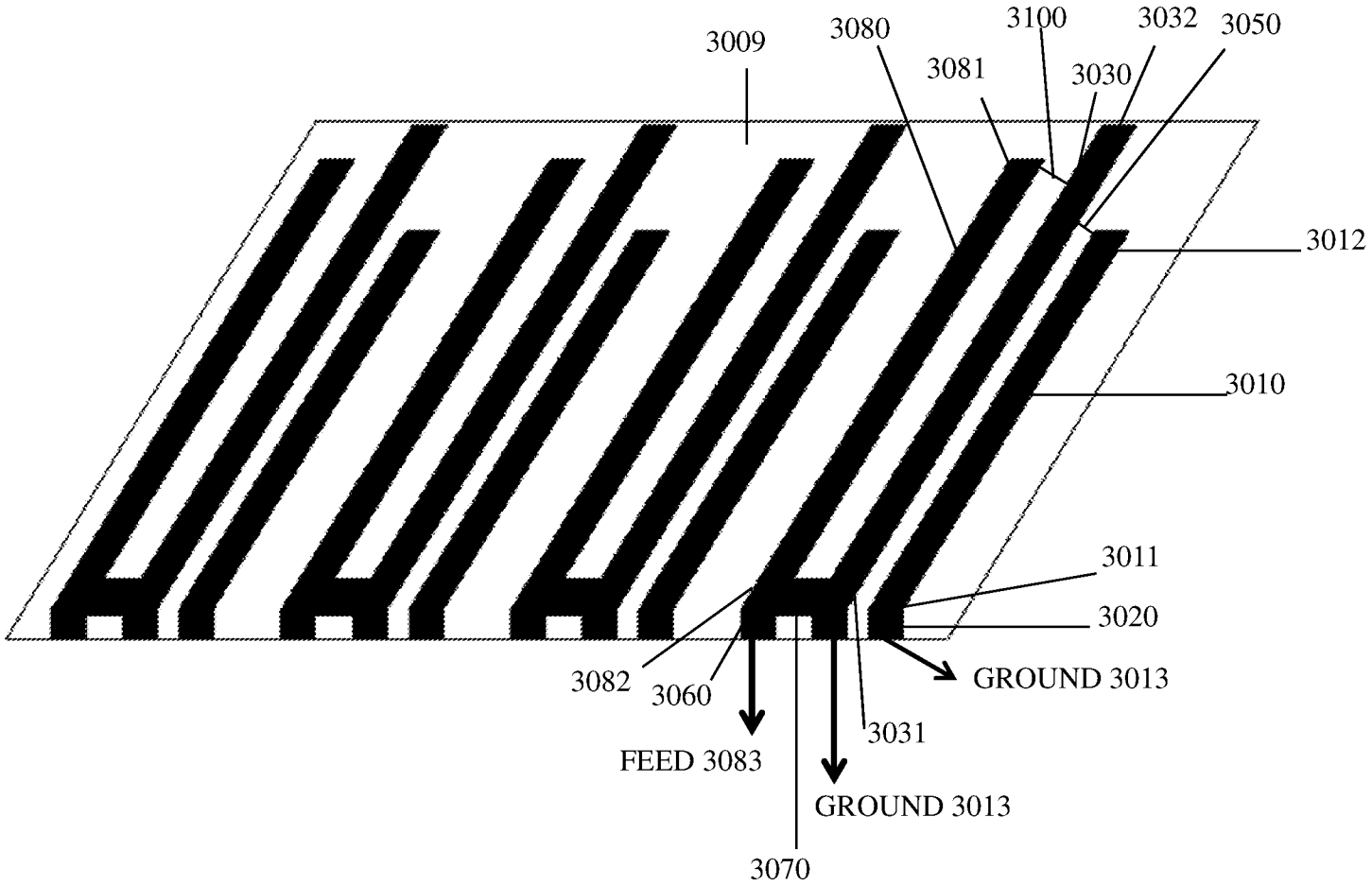
FIG. 3 illustrates an unwrapped plan view of a flat antenna printed circuit for a cylindrical quadrifilar helix antenna according to a third embodiment of the present inventions.

FIG. 3 illustrates an unwrapped plan view of a flat antenna printed circuit for a cylindrical quadrifilar helix antenna according to a third embodiment of the present inventions. A parasitic filar antenna element 3010 is shown which consists of a feed end 3011 and an opposing end 3012, where the feed end is connected to a common ground 3013 through a bottom section 3020. A primary filar antenna element 3030 is shown which consists of a feed end 3031 and an opposing end 3032, where the feed end is connected to a common ground 3013 through bottom section 3040. A substantially horizontal tuning strip 3070 is extended from the feed end 3031 of the filar antenna element 3030, and connects to a bottom section 3060 which is connected to a common ground 3013. A primary filar antenna element 3080 is shown which consists of a feed end 3081 and an opposing end 3082, where the feed end is connected to a feed 3083 through a bottom section 3060. Filar antenna elements 3030 and 3080 are coupled through the tuning strip 3050.

The filar antenna elements 3010 and 3030 are adjacently spaced by narrow distance 3050 yielding strong capacitive coupling between the primary filar antenna element 3030 and the parasitic filar antenna element 3010. The primary filar antenna element 3030 has a resonance frequency corresponding to its electrical length, ideally a quarter of a wavelength, or an odd multiple of a quarter of a wavelength corresponding to a higher order mode at a primary desired frequency. Due to the capacitive coupling between the two filar antenna elements 3010 and 3030, the parasitic filar antenna element 3010 also has a resonance frequency corresponding to its electrical length, ideally a quarter of a wavelength, or an odd multiple of a quarter of a wavelength corresponding to a higher order mode of a parasitic desired frequency.

By sufficiently decreasing the distance 3050, the bandwidth of the resonance corresponding to the parasitic filar antenna element 3010 will increase and will be comparable to the bandwidth of the resonance of the primary filar antenna elements 3030 and 3080.

Furthermore, as a result of such coupling distance, both filar antenna elements 3010 and 3030 will have a longer electrical length relative to their physical length. In order to achieve the desired resonant frequency for each of these two filar antenna elements, the required physical length of each filar antenna element 3010, 3030 becomes shorter as the parasitic distance 3050 decreases. As a result using this approach leads to shorter overall antenna height.

Electrical length is also dependent on environment factors such as dielectric constant of any surrounding objects such as the substrate, a cylindrical sleeve, or a radome.

The coupling between filar antenna elements 3010 and 3030 has a direct effect on their electrical length too, in a mutual way. Changing the length of each of the two filar antenna elements 3010 and 3030 will affect the electrical length and hence the resonance frequency of the other. Hence the two filar antenna elements 3010 and 3030 must be designed and matched simultaneously.

The length of the tuning strip 3070 is chosen such that it helps match filar antenna element 3080 to the feed line, yet still maintain a separation distance 3100 between filar antenna elements 3030 and 3080 such there is no capacitive coupling between them or that it is reduced to a practically insignificant level. The impedance of the feed line is 50 ohms.

The primary filar antenna element 3080 has a resonant frequency corresponding to its electrical length, ideally a quarter of a wavelength, or an odd multiple of a quarter of a wavelength corresponding to a higher order mode at a primary desired frequency.

While in a preferred embodiment of the invention, the filar antenna elements 3010, 3030 and 3080 each have an electrical length equal to an odd multiple of a quarter of a wavelength at the desired frequency of each, such electrical length is not a requirement and shorter or longer electrical length for filar elements can still be used in alternative embodiments in conjunction with appropriate matching method.

The two illustrated ground connections 3013 are a direct electrical connection. An alternative ground connection is through a matching network. The illustrated feed connection 3083 is through a direct electrical connection. An alternative feed connection is through a matching network. Also in an alternative feed arrangement, filar antenna element 3030 connects to the feed 3083 through the bottom section 3040 and filar antenna element 3080 could couple to the ground 3013 through bottom end 3060. In an alternative arrangement of the parasitic filar antenna element 3010, the capacitive coupling is achieved between filar antenna elements 3010 and 3080, by moving filar antenna element 3010 sufficiently closer to filar antenna element 3080.

In FIG. 3 four identical groups of three filar antenna elements 3010, 3030 and 3080 are uniformly separated on a dielectric substrate 3009 that will be wrapped around a cylindrical sleeve to assemble the a quadrifilar helix antenna.

Figure 4:
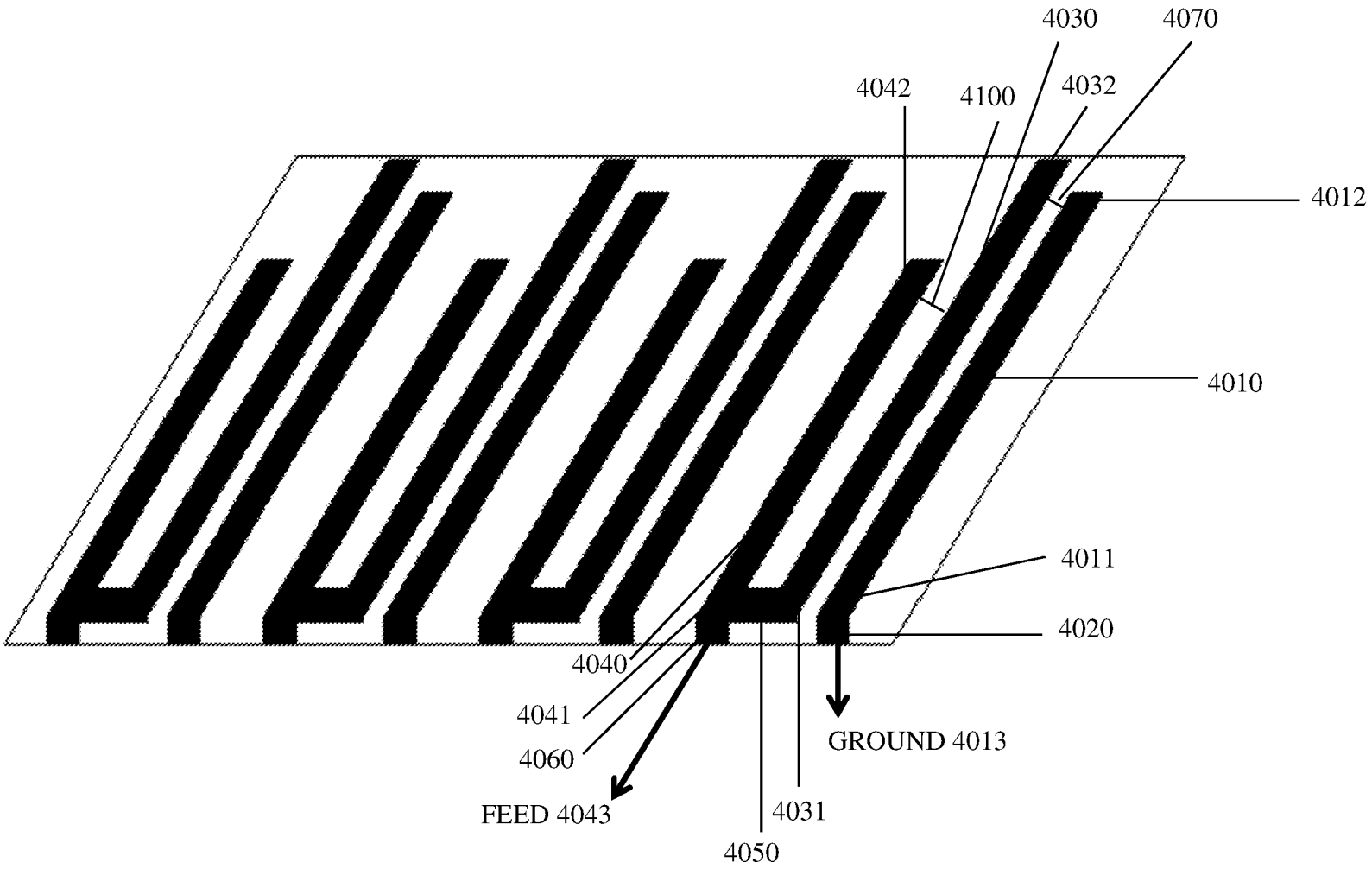
FIG. 4 illustrates an unwrapped plan view of a flat antenna printed circuit for a cylindrical quadrifilar helix antenna according to a forth embodiment of the present invention.

FIG. 4 illustrates an unwrapped plan view of a flat antenna printed circuit for a cylindrical quadrifilar helix antenna according to a forth embodiment of the present invention. A parasitic filar antenna element 4010 is shown which consists of a feed end 4011 and an opposing end 4012, where the feed end is connected to a common ground 4013 through a bottom section 4020. A primary filar antenna element 4030 is shown which consists of a feed end 4031 and an opposing end 4032, where the feed end is connected to a substantially horizontal conducting strip 4050. The conducting strip 4050 connects to a bottom section 4060 which is connected to a feed 4043. A primary filar antenna element 4040 is shown which consists of a feed end 4041 and an opposing end 4042, where the feed end is connected to the feed 4043 through a bottom section 4060. Filar antenna elements 4030 and 4040 are coupled through the tuning strip 4050.

The filar antenna elements 4010 and 4030 are adjacently spaced by a narrow distance 4050 yielding strong capacitive coupling between the parasitic filar antenna element 4010 and the primary filar antenna element 4030. The primary filar antenna element 4030 has a resonant frequency corresponding to its electrical length, ideally a quarter of a wavelength, or an odd multiple of a quarter of a wavelength corresponding to a higher order mode of a primary desired frequency. Due to the capacitive coupling between the two filar antenna elements 4010 and 4030, the parasitic filar antenna element 4010 will also receive or transmit signal at a frequency corresponding to its electrical length, ideally a quarter of a wavelength, or an odd multiple of a quarter of a wavelength corresponding to a higher order mode of a parasitic desired frequency.

By sufficiently decreasing the distance 4050, the bandwidth of the resonance corresponding to the parasitic filar antenna element 4010 will increase and will be comparable to the bandwidth of the resonance of the primary filar antenna elements 4030 and 4040.

Furthermore, as a result of such coupling distance, both filar antenna elements 4010 and 4030 will have a longer electrical length relative to their physical length. In order to achieve the desired resonant frequency for each of these two filar antenna elements, the required physical length of each filar antenna element 4010 and 4030 becomes shorter as the parasitic distance 4050 decreases.

The length of the tuning strip 4070 is chosen such that it helps match filar antenna element 4040 to the feed line, yet still maintain a separation distance 4100 between filar antenna elements 4030 and 4040 such that it there is not capacitive coupling between filar antenna elements 4030 and 4040 or it is reduced to a practically insignificant level. The distance 4100 is larger than parasitic distance 4070.

The primary filar antenna element 4040 has a resonant frequency corresponding to its electrical length, ideally a quarter of a wavelength, or an odd multiple of a quarter of a wavelength corresponding to a higher order mode of a primary desired frequency.

While in a preferred embodiment of the invention, the filar antenna elements 4010, 4030 and 4040 each have an electrical length equal to an odd multiple of a quarter of a wavelength at the desired frequency of each, such electrical length is not a requirement and shorter or longer electrical length for filar elements can still be used in alternative embodiments in conjunction with appropriate matching method.

The impedance of the feed line in embodiments is preferably 50 ohms. The parasitically coupled, adjacently spaced filar antenna elements in embodiments are parallel to one another or spaced along their lengths by substantially the same the narrow distance.

The illustrated ground connection 4013 is a direct electrical connection. An alternative ground connection is through a matching network. The illustrated feed connection 4043 is through a direct electrical connection. An alternative feed connection is through a matching network.

In FIG. 4 four identical groups of three filar antenna elements 4010, 4030 and 4040 are uniformly separated on a dielectric substrate 4009 that will be wrapped around a cylindrical sleeve to assemble the quadrifilar helix antenna.

Figure 5:
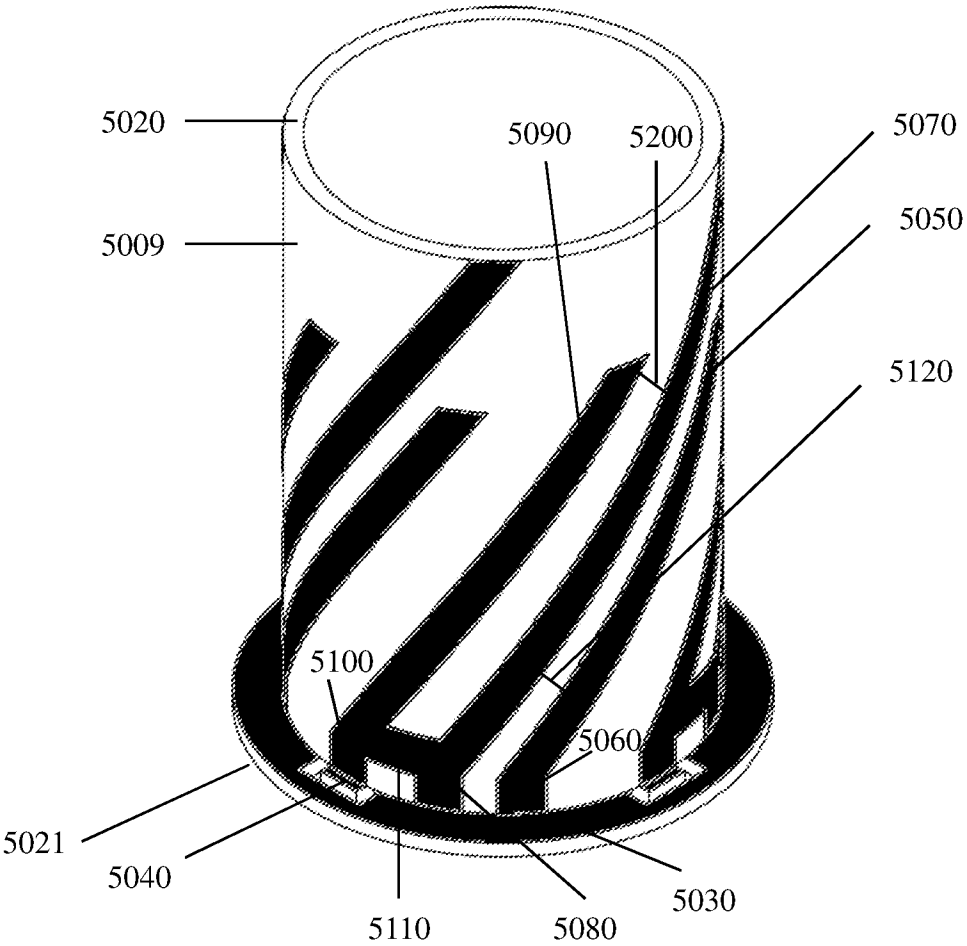
FIG. 5 illustrates a quadrifilar helix antenna according to a fifth embodiment of the present inventions.

FIG. 5 illustrates a quadrifilar helix antenna according to a fifth embodiment of the present inventions. An antenna printed circuit 5010 corresponds to the third embodiment of the inventions as shown. Four identical groups of three filar antenna elements similar to that in FIG. 3 are separated from each other by equal azimuth angles. The filar antenna elements are printed on a dielectric substrate 5009 and wrapped around a cylindrical sleeve 5020. The antenna is then mounted on a printed circuit board 5021 which contains the circuitry for a phased feed network and a common ground plane 5030.

A parasitic filar antenna element 5050 is connected to the common ground 5030 through a bottom section 5060. A primary filar antenna element 5070 is connected to the common ground 5030 bottom section. A primary filar antenna element 5090 is connected to the feed 5040 through a bottom section 5100. A substantially horizontal tuning strip 5110 is extended from the feed end of 5090 to the feed end of 5070 and connected to the common ground through bottom section 5080.

Each filar antenna element has a resonant frequency corresponding to its electrical length, ideally a quarter of a wavelength, or an odd multiple of a quarter of a wavelength corresponding to a higher order mode of a desired frequency for each filar antenna element. Hence a total of three frequency bands of operation are covered.

The distance 5120 between filar antenna elements 5050 and 5070 is chosen sufficiently small to create a strong capacitive coupling between the two. As a result of such coupling the resonance corresponding to the parasitic filar antenna element 5050 has a bandwidth comparable to the resonances corresponding to primary filar antenna elements 5070 and 5090.

Furthermore, as a result of such coupling, both filar antenna elements 5050 and 5070 will have a longer electrical length relative to their physical length. In order to achieve the desired resonant frequency for each of filar antenna elements 5050 and 5070, the required physical length of each becomes shorter as the parasitic distance 5050 decreases. As a result using this approach leads to shorter overall antenna height.

Electrical length is also dependent on environment factors such as dielectric constant of any surrounding objects such as the substrate, a cylindrical sleeve, or a radome.

The coupling between filar antenna elements 5050 and 5070 has a direct effect on their electrical length too, in a mutual way. Changing the length of each of the two filar antenna elements 5050 and 5070 will affect the electrical length and hence the resonance frequency of the other. Hence the two filar antenna elements 5050 and 5070 must be designed and matched simultaneously.

The length of the tuning strip 5110 is chosen such that it helps match filar antenna element 5090 to the feed line, yet still maintain a separation distance 5200 between filar antenna elements 5090 and 5070 such that there is not capacitive coupling between filar antenna elements 5090 and 5070 or it is reduced to a practically insignificant level. The distance 5200 is larger than parasitic distance 5120.

The ground connection between the two filar antenna elements 5050 and 5070 and the common ground 5030 is illustrated as a direct electrical connection. An alternative ground connection is through a matching network. The illustrated feed connection 5040 is through a direct electrical connection. An alternative feed connection is through a matching network. In an alternative arrangement for the feed, filar antenna element 5070 connects to the feed 5040 and filar antenna element 5090 connects to the common ground 5030. In an alternative arrangement of the parasitic filar antenna element 5050, the capacitive coupling is achieved between filar antenna elements 5050 and 5090, by moving filar antenna element 5050 sufficiently closer to filar antenna element 5090.

The common ground 5030 can be a ground plane as illustrated at an opposite end from the primary opposing ends of the primary filar antenna elements 5070 and 5090 and the parasitic opposing ends of the parasitic filar antenna elements 5050.

The quadrifilar antenna described in FIG. 5 conforms to the surface of a cylinder. In alternative structures, the multifilar antenna conforms to the surface of a sphere or a cone.

The illustrated embodiments of the invention correspond to a left hand circularly polarized signal. By simply reversing the direction of the winding and with appropriately phased feed network, identical results are achieved for a right hand circularly polarized antenna.

Figure 6:
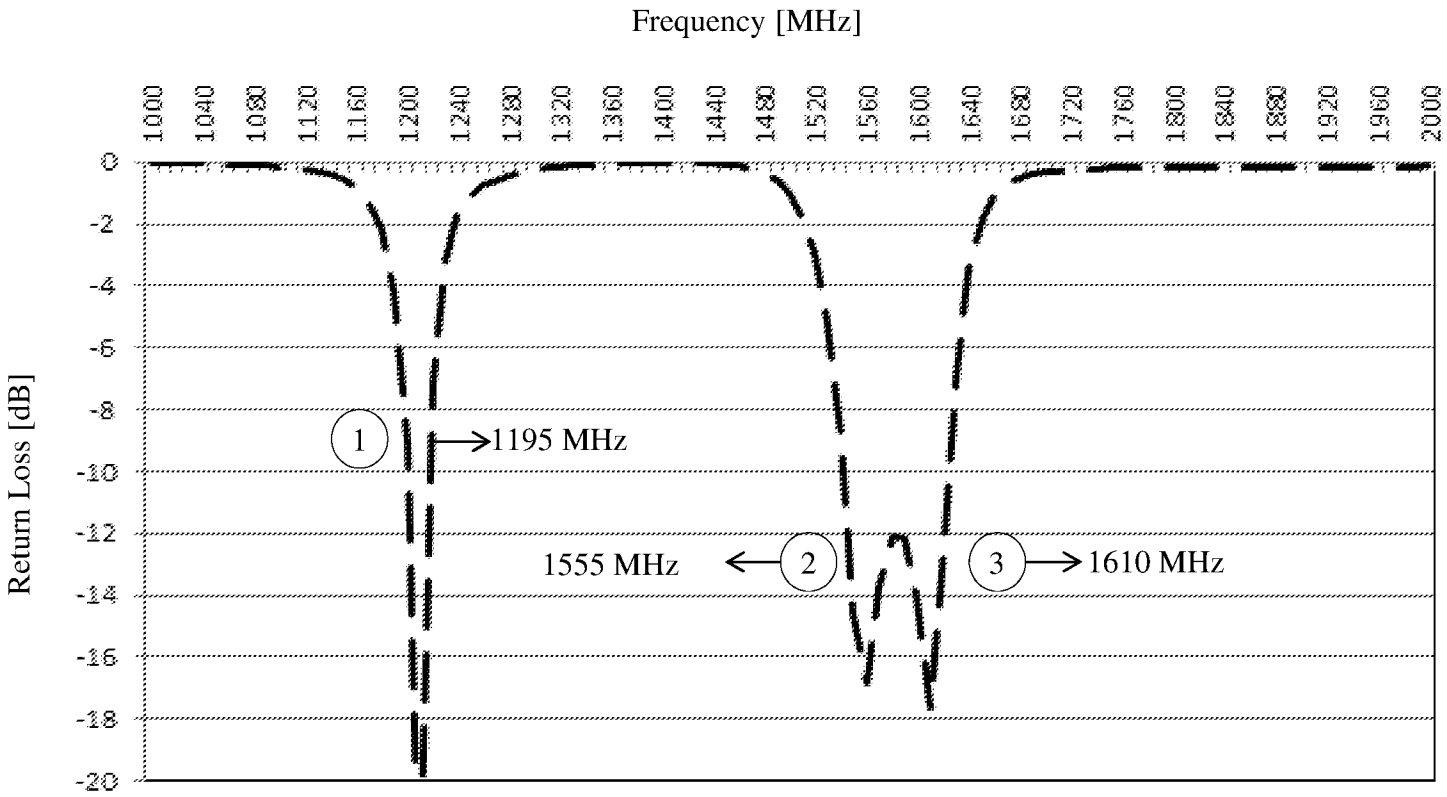
FIG. 6 illustrates a frequency return loss graph of the return loss of a tri-band quadrifilar helix antenna similar to the fifth embodiment of FIG. 5.

FIG. 6 illustrates a frequency return loss graph of the return loss of a tri-band quadrifilar helix antenna similar to the fifth embodiment of FIG. 5, where the length of the filar antenna elements 5050, 5070 and 5090 are chosen to be 33.5 mm, 39.5 and 34.5 mm. The separation 5120 is 2 mm and the length of the tuning strip 5100 is 4 mm. The dielectric sleeve 5020 has a dielectric constant of 2. The outer diameter of the dielectric sleeve is 28 mm and the thickness of the dielectric sleeve is 1 mm. The width of each filar antenna element is 3 mm. For the particular dimensions mentioned, three separate resonances are observed. Resonance number 1 at 1190 MHz corresponds to filar antenna element 5070, resonance number 2 at 1555 MHz corresponds to filar antenna element 5050, and resonance number 3 at 1610 MHz corresponds to filar antenna element 5090. Even though the physical length of filar antenna element 5050 is shorter than the physical length of filar antenna element 5090, it resonates at a lower frequency of 1555 MHz compared to resonant frequency of filar antenna element 5090 which occurs at 1610 MHz. This is due the fact that electrical length of filar antenna element 5050 is longer than that of filar antenna element 5090. The longer electrical length of filar antenna element 5050 is due to its capacitive coupling to filar antenna element 5080.

The parasitic distance is a distance up to where the primary and parasitic physical lengths relative to the primary and parasitic electrical lengths are, practically speaking, essentially unaffected by parasitic coupling therebetween. This parasitic distance can be a range between zero and the distance were the physical lengths relative to the electrical lengths are measurably unaffected by the parasitic coupling.

Figure 7:
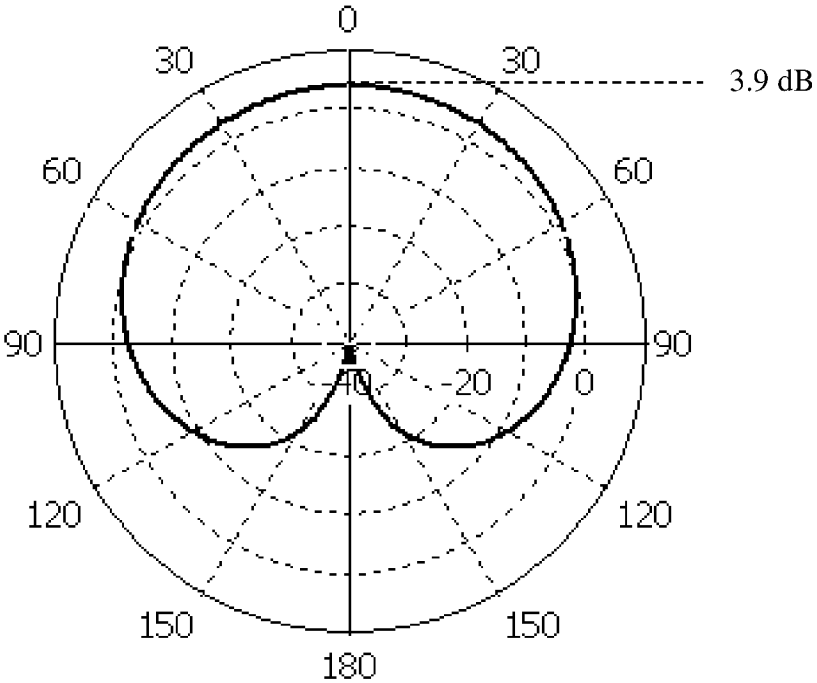
FIG. 7 illustrates a polar radiation pattern plot of the left hand circularly polarized (LHCP) realized gain of a tri-band quadrifilar helix antenna similar to the fifth embodiment of FIG. 5.

FIG. 7 illustrates a polar radiation pattern plot of the left hand circularly polarized (LHCP) realized gain of a tri-band quadrifilar helix antenna similar to the fifth embodiment of FIG. 5. The LHCP gain is plotted versus polar angle theta at its first operating band at 1190 MHz, corresponding to resonance number 1 shown in FIG. 6. A peak gain of 3.9 dB is observed at theta equal to zero.

Figure 8:
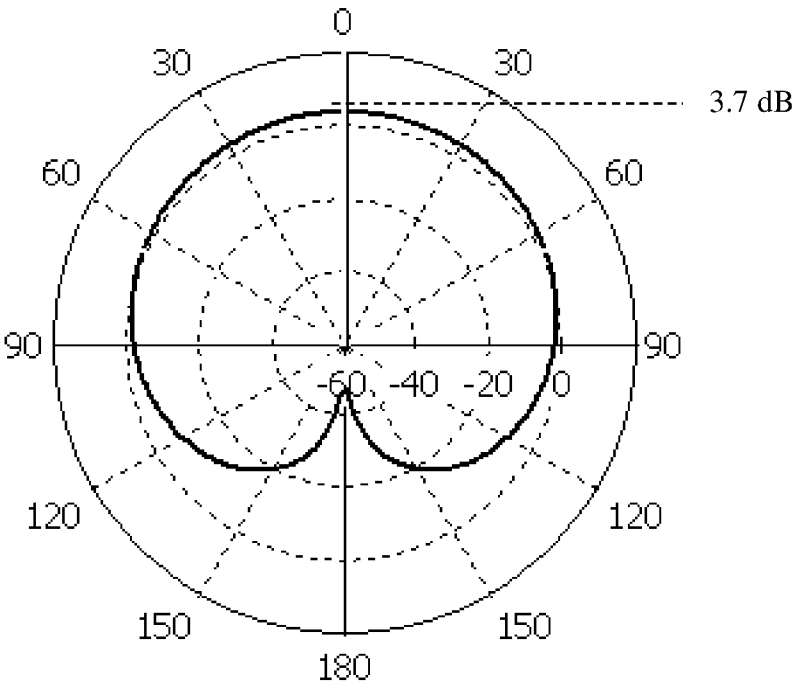
FIG. 8 illustrates a polar radiation pattern plot of the LHCP realized gain of a tri-band quadrifilar helix antenna similar to the fifth embodiment of FIG. 5.

FIG. 8 illustrates a polar radiation pattern plot of the LHCP realized gain of a tri-band quadrifilar helix antenna similar to the fifth embodiment of FIG. 5. The LHCP gain is plotted versus polar angle theta at the second operating band of the antenna, at 1555 MHz, corresponding to resonance number 2 shown in FIG. 6. A peak gain of 3.7 dB is observed at theta equal to zero.

Figure 9:
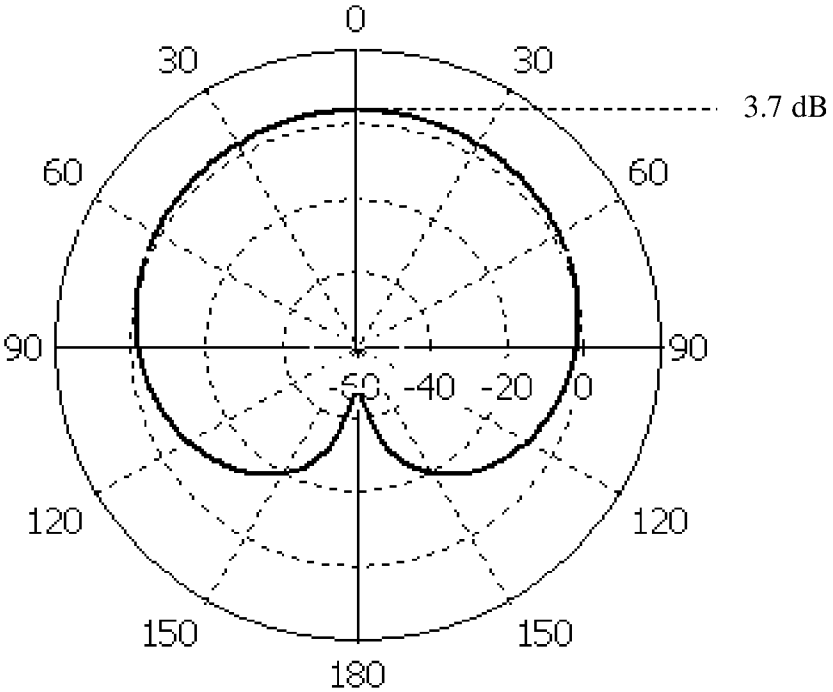
FIG. 9 illustrates a polar radiation pattern plot of the LHCP realized gain of a tri-band quadrifilar helix antenna similar to the fifth embodiment of FIG. 5.

FIG. 9 illustrates a polar radiation pattern plot of the LHCP realized gain of a tri-band quadrifilar helix antenna similar to the fifth embodiment of FIG. 5. The LHCP gain is plotted versus polar angle theta at the third operating band of the antenna, at 1610 MHz, corresponding to resonance number 3 shown in FIG. 6. A peak gain of 3.7 dB is observed at theta equal to zero.

Figure 10:
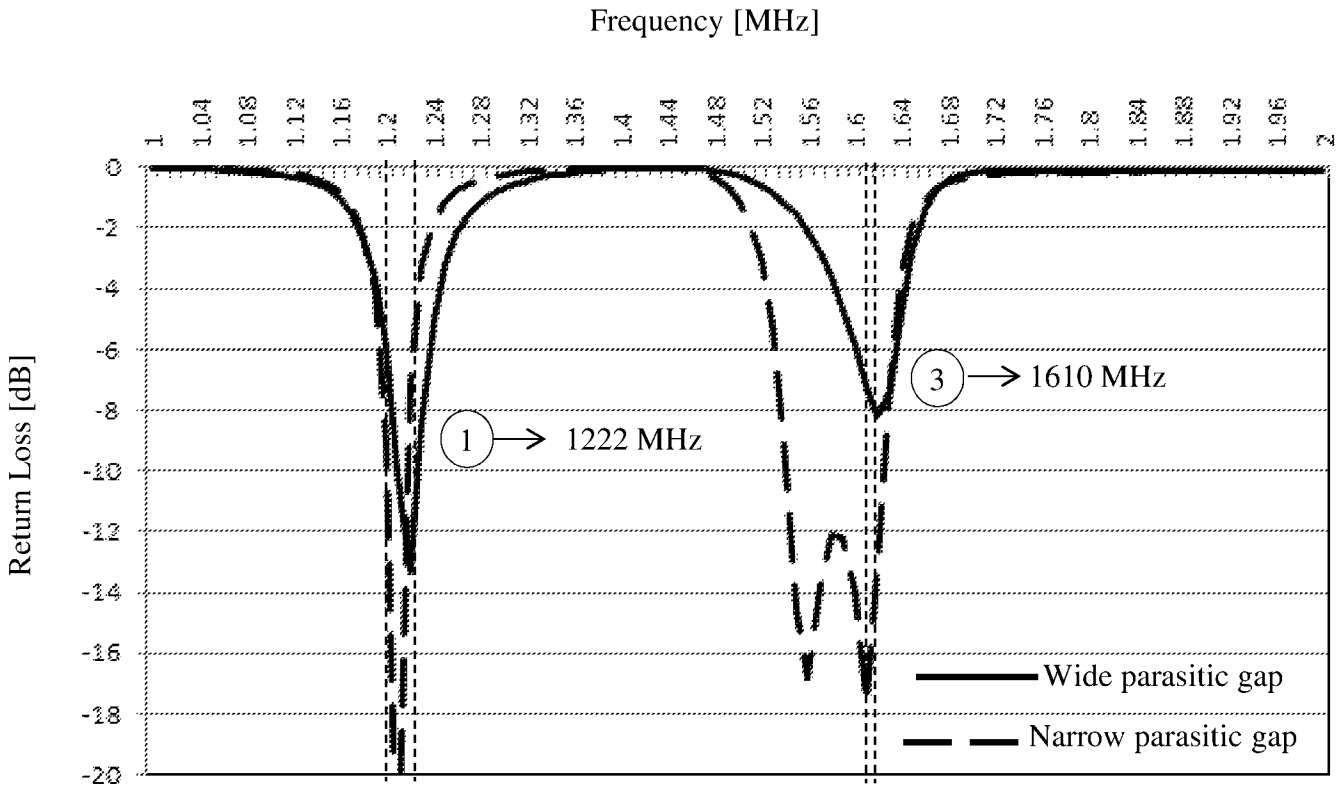
FIG. 10 illustrates a frequency return loss graph of two curves corresponding to the return loss of two tri-band antennas, both similar to a tri-band quadrifilar helix antenna of the fifth embodiment of FIG. 5.

FIG. 10 illustrates a frequency return loss graph of two curves corresponding to the return loss of two tri-band antennas, both similar to a tri-band quadrifilar helix antenna of the fifth embodiment of FIG. 5. One of these two tri-band antennas has a narrow parasitic gap illustrated by a dashed curve. Another of these two tri-band antennas has a wide parasitic gap illustrated by a solid curve. For both antennas, the length of the filar antenna elements 5050, 5070 and 5090 are chosen to be 33.5 mm, 39.5 and 34.5 mm. The length of the tuning strip 5100 is 4 mm. The dielectric sleeve 5020 has a dielectric constant of 2. The thickness of the dielectric sleeve is 1 mm. The width of each filar antenna element is 3 mm. The two antennas have different values for parasitic distance 5120. In one of them distance 5120 is 2 mm (corresponding to the dashed curve) and in the other one 4 mm (corresponding to the solid curve), but the two antennas are otherwise identical. It is demonstrated that in the antenna with sufficiently small distance between the parasitic element and the feed element, three separate resonance frequencies are observed. Resonant frequency number 1 at 1190 MHz corresponds to parasitic filar antenna element 5050, number 2 at 1555 MHz corresponds to primary filar antenna element 5070, and number 3 at 1610 MHz to primary filar antenna element 5090. Despite the physical length of filar antenna element 5090 being shorter than that of filar antenna element 5080, it resonates at a lower frequency. This is due to the fact that the electrical length of 5050 is longer than electrical length of 5090, due to the parasitic coupling with filar antenna elements 5050 and 5070. Upon increasing distance 5210 to 4 mm (the solid curve) and hence avoiding the parasitic coupling, the resonance frequency of the feed element 5070 is shifted higher by about 30 MHz. In absence of the capacitive coupling a longer physical length of the filar antenna element 5070 is needed to create the electrical length required to create the resonance at the same frequency of 1190 MHz. Also, resonance number 2 at 1555 MHz which was due to filar antenna element 5050, has shifted higher, become less efficient and merged with the resonance number 3.

Figure 11:
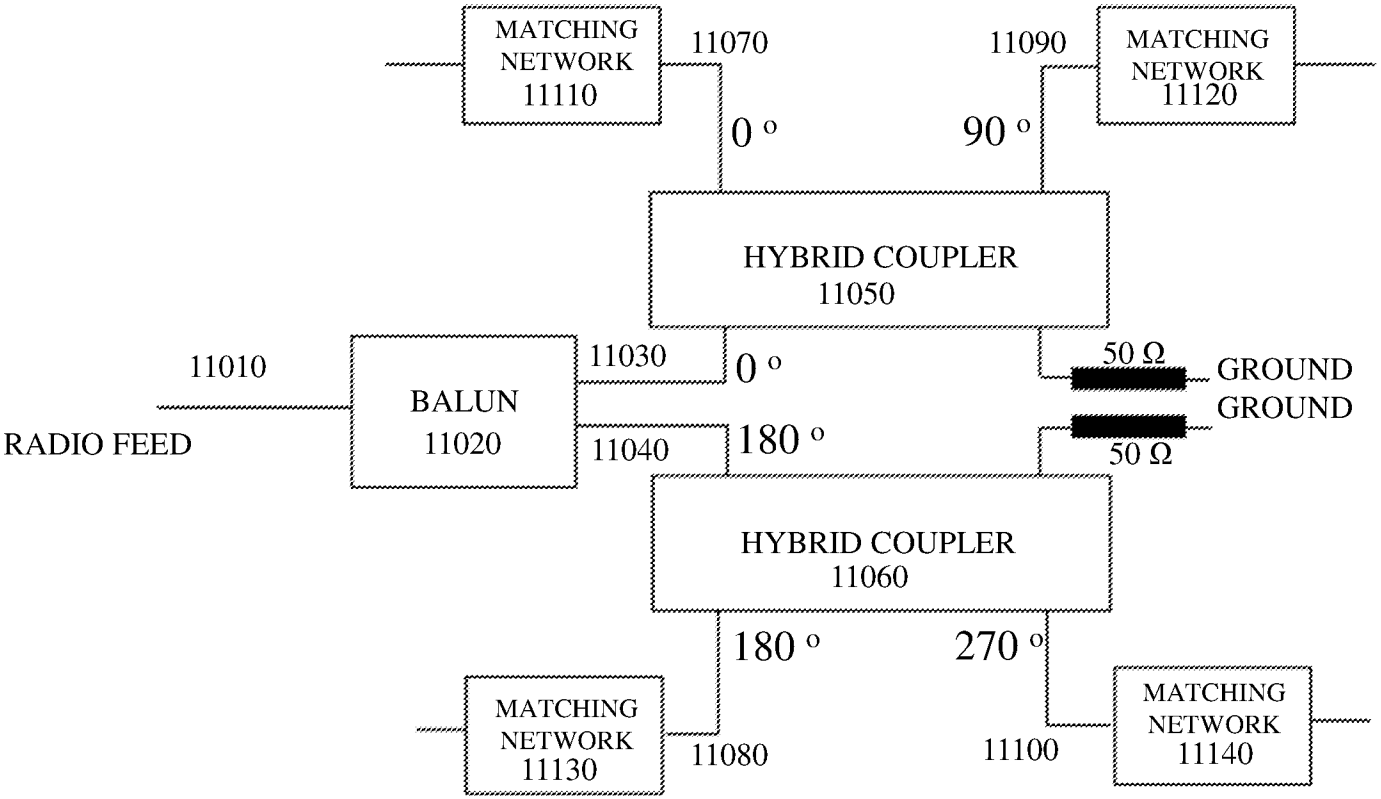
FIG. 11 illustrates a schematic block diagram of an exemplary implementation of the feed network for embodiments of the present inventions.

FIG. 11 illustrates a schematic block diagram of an exemplary implementation of the feed network for embodiments of the present inventions. As shown in FIG. 1, FIG. 2, FIG. 3, FIG. 4 and FIG. 5, four groups of filar antenna elements are separated from each other by equal azimuth angles around the circumference of the cylinder and one element in each group, the same in every group, is connected to a feed. The phase of the feed signal at each feed element progresses uniformly. In the case of a quadrifilar, the progression is in 90 degree increments. To generate such phasing, the radio feed 11010 connects to a 1:2 balun 11020, the two outputs 11030 and 11040 of which have the same amplitude but are 180 degrees out of phase with respect to each other. Balun output port 11030 is then connected to the hybrid coupler 11050 and balun output port 11040 is connected to hybrid coupler 11060. In each hybrid coupler, the input port couples to two of the output ports, the signal on one of which has the same phase as the input of the hybrid coupler (11070 and 11080), and the phase of the other one is lagging by 90 degrees (11090 and 11100), but the two have equal amplitude. The outputs of the hybrid couplers 11070, 11080, 11090 and 11100 have equal amplitude and progressive phase with 90 degree increments. The total of four hybrid coupler outputs 11070, 11080, 11090 and 11100 each connect to matching networks 11110, 11120, 11130 and 11140 respectively. The matching networks are then connected to the primary filar antenna elements in each group of filar antenna elements of the antenna.

In an alternative implementation of the phase progression, sections of transmission lines with a specific length are used to generate a certain phase delay. In another possible implementation hybrid couplers or hybrid couplers in conjunction with transmission lines are used to generate the phase delay.

In the embodiments, the connections of the filar antenna elements to a ground or a feed, can be a direct electrical connection, or can be through a matching network consisting of matching parts or transmission lines or a combination of both.

Figure 12:
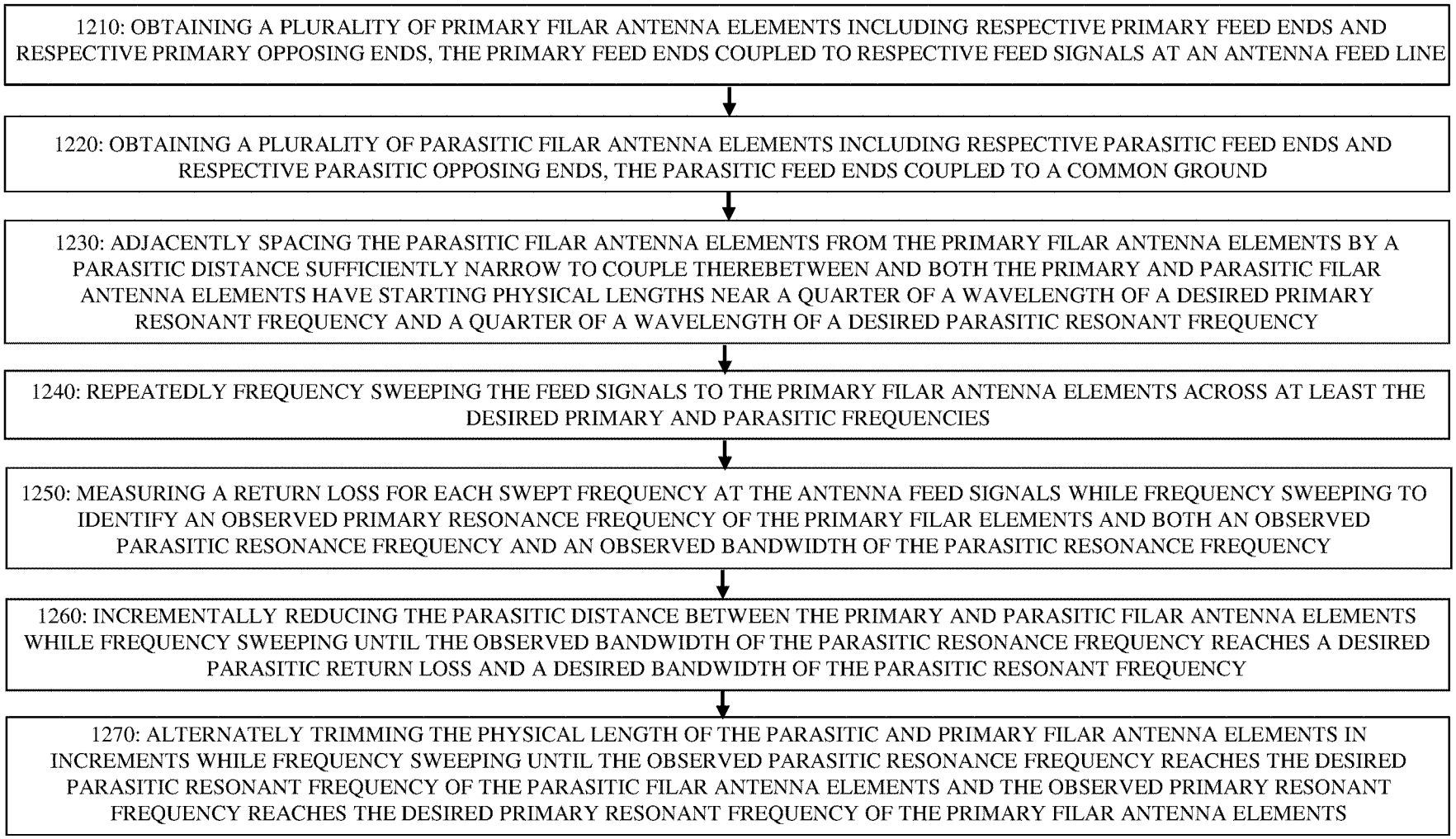
FIG. 12 illustrates a flowchart of a process for making a multi-band antenna according to embodiments of the present inventions.

FIG. 12 illustrates a flowchart of a process for making a multi-band antenna according to embodiments of the present inventions. In step 1210, a plurality of primary filar antenna elements including respective primary feed ends and respective primary opposing ends are obtained and the primary feed ends are coupled to respective feed signals at an antenna feed line. In step 1220, a plurality of parasitic filar antenna elements including respective parasitic feed ends and respective parasitic opposing ends are obtained and the parasitic feed ends are coupled to a common ground.

In step 1230, the parasitic filar antenna elements obtained in step 1210 are adjacently spaced from the primary filar antenna elements obtained in step 1220 by a parasitic distance sufficiently narrow to couple therebetween and both the primary filar antenna elements and the parasitic filar antenna elements have starting physical lengths near a quarter of a wavelength or an odd multiple of a quarter of a wavelength of a desired primary resonant frequency of the primary filar antenna elements and a quarter of a wavelength or an odd multiple of a quarter of a wavelength of a desired parasitic resonant frequency of the parasitic filar antenna elements.

In step 1240, a frequency sweep of the feed signal at the primary filar elements is performed such that it sweeps across at least the desired primary frequency and the desired parasitic frequency.

In step 1250, the return loss for each swept frequency at the antenna feed signal is measured and an observed primary resonance frequency of the primary filar antenna elements and both an observed parasitic resonance frequency and an observed bandwidth of the parasitic resonance frequency of the parasitic filar elements are identified while frequency sweeping in step 1240 is continued.

In step 1260, the parasitic distance between the primary filar antenna elements and the parasitic filar antenna elements is reduced in increments while the frequency sweeping in step 1240 is continued until the bandwidth of the parasitic resonance frequency of the parasitic filar antenna element reaches a desired parasitic return loss and a desired bandwidth of the parasitic resonant frequency of the parasitic filar elements.

In step 1270, the physical length of the parasitic filar antenna elements and the primary filar antenna elements are alternately trimmed in increments while frequency sweeping according to step 1240 is continued until the observed parasitic resonance frequency of the parasitic filar antenna elements reaches the desired parasitic resonant frequency of the parasitic filar antenna elements and the observed primary resonant frequency of the primary filar antenna elements reaches the desired primary resonant frequency of the primary filar antenna elements.

Steps 1250, 1260 and 1270 can be performed in any order. Steps 1250, 1260 and 1270 can also be performed iteratively.

It is understood that an antenna element in the real world might not reach a perfect match or return loss due to slight imperfections or tolerances in the materials and equipment in embodiments of the inventions.

Any letter designations such as (a) or (b) etc. used to label steps of any of the method claims herein are step headers applied for reading convenience and are not to be used in interpreting an order or process sequence of claimed method steps. Any method claims that recite a particular order or process sequence will do so using the words of their text, not the letter designations.

Unless stated otherwise, terms such as "first" and "second" are used to arbitrarily distinguish between the elements such terms describe. Thus, these terms are not necessarily intended to indicate temporal or other prioritization of such elements.

Any trademarks listed herein are the property of their respective owners, and reference herein to such trademarks is generally intended to indicate the source of a particular product or service.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure.

What is claimed is:

1. A multi-band antenna, comprising:

a plurality of primary filar antenna elements including respective primary feed ends and respective primary opposing ends, the primary feed ends coupled to respective feed signals, wherein the plurality of primary filar antenna elements have primary electrical lengths and primary physical lengths between the respective primary feed ends and the respective primary opposing ends; and a plurality of parasitic filar antenna elements, each parasitically coupled to a corresponding primary filar antenna element, and including respective parasitic feed ends and respective parasitic opposing ends, the parasitic feed ends coupled to a common ground, wherein the plurality of parasitic filar antenna elements have parasitic electrical lengths and parasitic physical lengths between the respective parasitic feed ends and the respective parasitic opposing ends; and wherein respective primary filar antenna elements and parasitic filar antenna elements are adjacently spaced from one another by a parasitic distance sufficiently narrow to shorten the primary physical lengths and the parasitic physical lengths relative to the primary electrical lengths and the parasitic electrical lengths and wherein the primary electrical lengths are different than the parasitic electrical lengths to resonate at respective different frequencies.

2. A multi-band antenna according to claim 1, wherein the parasitic distance is in a range between zero and a distance were the primary physical lengths and the parasitic physical lengths relative to the primary electrical lengths and the parasitic electrical lengths are unaffected by parasitic coupling therebetween.

3. A multi-band antenna according to claim 2, wherein the parasitic distance is a distance up to where were the primary physical lengths and the parasitic physical lengths relative to the primary electrical lengths and the parasitic electrical lengths are unaffected by parasitic coupling therebetween.

4. A multi-band antenna according to claim 1, wherein both the primary filar antenna elements and the parasitic filar antenna elements have physical lengths shorter than a quarter of a wavelength or an odd multiple of a quarter of a wavelength corresponding to a higher order mode of a frequency of operation of the primary filar antenna elements and a quarter of a wavelength or an odd multiple of a quarter of a wavelength corresponding to a higher order mode of a frequency of operation of the parasitic filar antenna elements.

5. A multi-band antenna according to claim 1, wherein respective primary filar antenna elements and parasitic filar antenna elements are capacitively coupled across the parasitic distance.

6. A multi-band antenna according to claim 1, wherein respective primary filar antenna elements and parasitic filar antenna elements have different physical lengths.

7. A multi-band antenna according to claim 1, further comprising an additional filar antenna element including a bottom end and a top end.

8. A multi-band antenna according to claim 7, wherein the additional filar antenna element further includes the bottom ends of the additional filar antenna elements coupled to the common ground.

9. A multi-band antenna according to claim 8, wherein the bottom ends of the primary and additional filar antenna elements are coupled through a tuning strip, wherein the tuning strip has a length chosen to achieve matching to an impedance of the feed lines.

10. A multi-band antenna according to claim 7, wherein the additional filar antenna element is distanced from the primary filar antenna element a separation distance sufficient to avoid capacitive coupling therebetween.

11. A multi-band antenna according to claim 10, wherein the separation distance is greater than the parasitic distance.

12. A multi-band antenna according to claim 10, wherein the additional filar antenna element further includes the bottom ends of the additional filar antenna elements coupled to the common ground; and wherein the bottom ends of the primary and additional filar antenna elements are coupled through a tuning strip, wherein the tuning strip has a length chosen to help match to an impedance of a feed line for the feed signals yet still achieve a separation distance sufficient to avoid the capacitive coupling between the additional filar antenna element and the primary filar antenna element.

13. A multi-band antenna according to claim 1, wherein the common ground is at an opposite end from the primary opposing ends and the parasitic opposing ends of the primary and parasitic filar antenna elements.

14. A multi-band antenna according to claim 1, wherein the common ground is on a circuit board at a bottom of the multi-band antenna.

15. A multi-band antenna according to claim 1, wherein the antenna elements helically conform to a cylindrical surface.

16. A multi-band antenna according to claim 1, further comprising:

a printed circuit board including a phased feeding network comprising a ground plane for the common ground, wherein the phased feeding network comprises signal ports coupled to the feed lines having equal amplitudes and a predetermined phase difference between adjacent ports.

17. A process for creating a multi-band antenna according to claim 1 with a parasitic distance sufficiently narrow to shorten the primary physical lengths and the parasitic physical lengths relative to the primary electrical lengths and the parasitic electrical lengths, comprising the steps of:

(a) obtaining a plurality of primary filar antenna elements including respective primary feed ends and respective primary opposing ends, the primary feed ends coupled to respective feed signals at an antenna feed line;

(b) obtaining a plurality of parasitic filar antenna elements, each parasitically coupled to a corresponding primary filar antenna element, and including respective parasitic feed ends and respective parasitic opposing ends, the parasitic feed ends coupled to a common ground;

(c) adjacently spacing the parasitic filar antenna elements obtained in said step (a) from the primary filar antenna elements obtained in said step (b) by a parasitic distance sufficiently narrow to couple therebetween and both the primary filar antenna elements and the parasitic filar antenna elements have starting physical lengths near a quarter of a wavelength or an odd multiple of a quarter of a wavelength of a desired primary resonant frequency of the primary filar antenna elements and a quarter of a wavelength or an odd multiple of a quarter of a wavelength of a desired parasitic resonant frequency of the parasitic filar antenna elements;

(d) after the spacing in said step (c), repeatedly frequency sweeping the feed signals to the primary filar antenna elements across at least the desired primary frequency and the desired parasitic frequency;

(e) measuring a return loss for each swept frequency at the antenna feed signals while frequency sweeping according to step (d) to identify an observed primary resonance frequency of the primary filar elements and both an observed parasitic resonance frequency and an observed bandwidth of the parasitic resonance frequency of the parasitic filar elements;

(f) incrementally reducing the parasitic distance between the primary filar antenna elements and the parasitic filar antenna elements while frequency sweeping according to step (d) until the observed bandwidth of the parasitic resonance frequency of the parasitic filar antenna element reaches a desired parasitic return loss and a desired bandwidth of the parasitic resonant frequency of the parasitic filar elements; and (g) alternately trimming the physical length of the parasitic filar antenna elements and the primary filar antenna elements in increments while frequency sweeping according to step (d) until the observed parasitic resonance frequency of the parasitic filar antenna elements reaches the desired parasitic resonant frequency of the parasitic filar antenna elements and the observed primary resonant frequency of the primary filar antenna elements reaches the desired primary resonant frequency of the primary filar antenna elements.

18. A multi-band antenna made according to the process of claim 17.

* * * * *